United States Patent [19]

Theurer et al.

[11] 4,263,851

[45] Apr. 28, 1981

[54] MOBILE BALLAST CLEANING MACHINE

[75] Inventors: Josef Theurer, Vienna; Karl Fölser, Linz-Urfahr, both of Austria

[73] Assignee: Franz Plasser Bahnbaumaschinen-Industriegesellschaft m.b.H., Vienna, Austria

[21] Appl. No.: 13,383

[22] Filed: Feb. 21, 1979

[30] Foreign Application Priority Data

May 9, 1978 [AT] Austria ..... 3365/78

[51] Int. Cl.[3] ..... E01B 27/10; E01B 29/04

[52] U.S. Cl. ..... 104/7 R; 37/104; 104/2; 171/16; 414/528

[58] Field of Search ..... 104/1 R, 2, 7 R, 7 B, 104/12; 171/16; 37/104–107; 414/339, 528

[56] References Cited

U.S. PATENT DOCUMENTS

| | | | |
|---|---|---|---|
| 2,775,438 | 12/1956 | Bach et al. | 171/16 X |
| 3,872,929 | 3/1975 | Theurer et al. | 104/2 X |
| 3,976,142 | 8/1976 | Plasser et al. | 171/16 |
| 4,108,076 | 8/1978 | Knape | 104/2 |

FOREIGN PATENT DOCUMENTS

| | | | |
|---|---|---|---|
| 447126 | 7/1927 | Fed. Rep. of Germany | 414/528 |
| 2612536 | 10/1976 | Fed. Rep. of Germany | 171/16 |

*Primary Examiner*—Randolph A. Reese
*Attorney, Agent, or Firm*—Kurt Kelman

[57] ABSTRACT

A mobile ballast cleaning machine comprises a frame running on two undercarriages a rear one of which is supported on a track section resting on cleaned ballast. A ballast excavating and conveying chain is mounted on the frame in front of this track section and a ballast screening mechanism on the frame receives the excavated ballast from the chain, cleans it and discharges the cleaned ballast to a storage receptacle arranged on the frame between the undercarriages. The storage receptacle has sufficient capacity to hold a volume of the cleaned ballast corresponding to that of the excavated ballast and a rising ballast conveyor is mounted in the storage receptacle for distributing the cleaned ballast therein. The cleaned ballast is discharged from the storage receptacle for redistribution by a ballast conveyor system and devices for regulating the flow of the cleaned ballast and for guiding the same between the discharge from the receptacle and the ballast conveyor system.

15 Claims, 4 Drawing Figures

MOBILE BALLAST CLEANING MACHINE

Figures 1, 2, 3, 4:
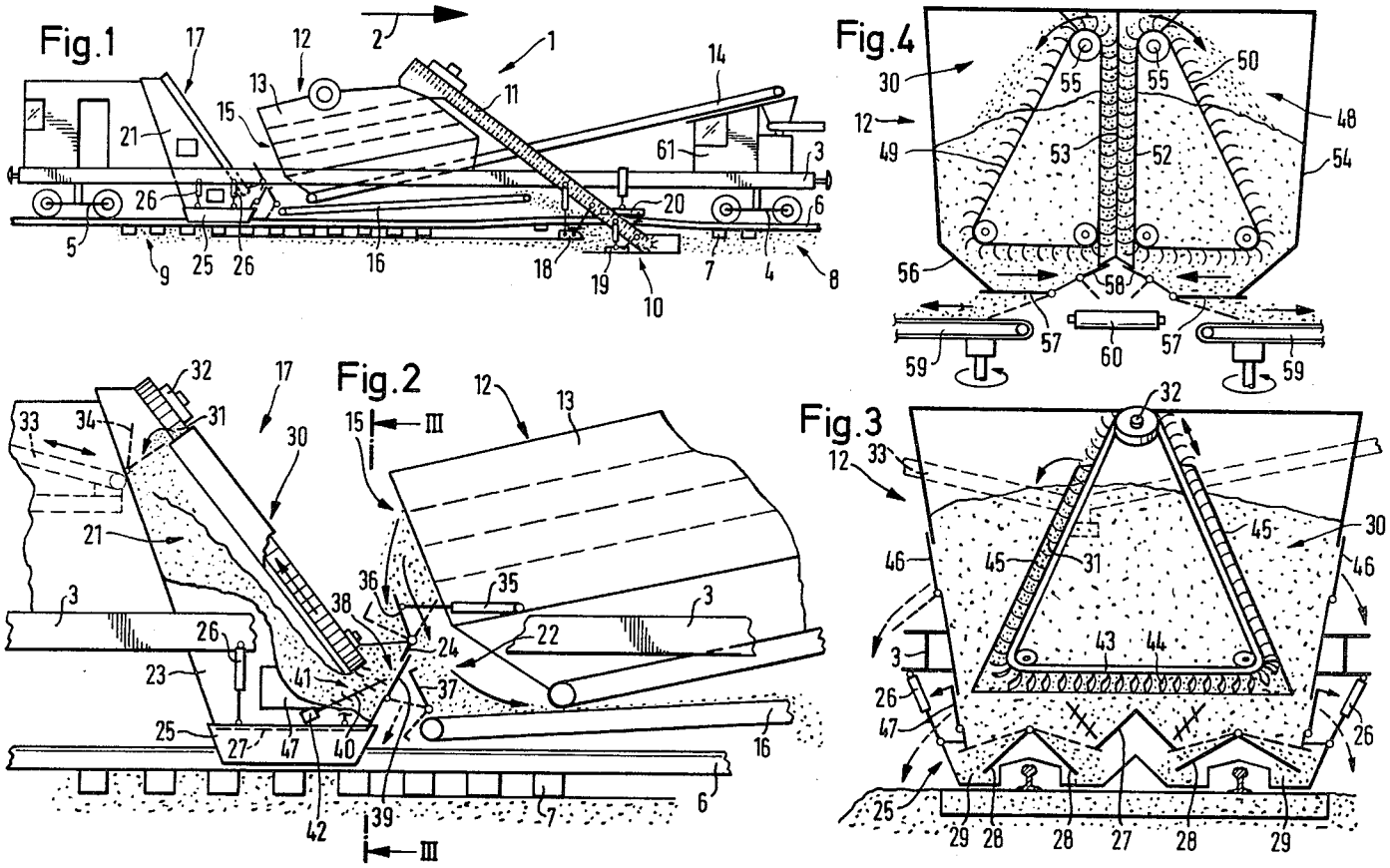

The present invention relates to a mobile, self-propelled ballast cleaning machine comprising a frame mounted on two undercarriages for mobility along a track in an operating direction, a rear one of the undercarriages being supported on a track section resting on cleaned ballast.

U.S. Pat. No. 3,976,142, dated Aug. 24, 1976, discloses such a ballast cleaning machine wherein an endless ballast excavating chain is arranged on the frame to have a portion extending transversely underneath a lifted track section for removing ballast from the ballast bed and to move the ballast to be cleaned to a ballast screening and cleaning means. The cleaned ballast is then controllably conveyed and redistributed in the ballast bed. To enable the uneven supply of cleaned ballast to be equalized over an extended operating range, a ballast storage receptacle for the cleaned ballast is positioned in the conveying path through which the cleaned ballast passes for redistribution. This storage receptacle is mounted below the ballast redistributing conveyor in the range of the track section where the ballast has been excavated. This not only hides this track area from view but also takes so much room that it is difficult, if not impossible, to mount other ballast treating equipment there. Since this is usually about centrally between the front and rear undercarriages of the machine frame and the stored cleaned ballast is heavy, this arrangement, furthermore, subjects the entire frame to a considerable load.

In another known mobile ballast cleaning machine described in German patent application No. 2,612,536, published Oct. 14, 1976, a storage receptacle is similarly arranged in a track section where dirty or encrusted ballast has been excavated and the redistributed cleaned ballast is discharged. The receptacle has a bottom with adjustable ballast discharge outlets for distributing the cleaned ballast selectively from the receptacle. The storage receptacle is supported on its own wheels on the track in an effort to relieve the machine frame from the heavy load but the location of the large-volume receptacle still blocks the entire excavating and redistribution area. In addition, since the heavy storage receptacle is supported on a track section which is suspended and without ballast support, the track tends to be depressed below grade and the track rails are sometimes loaded beyond capacity. Furthermore, the storage receptacle and the adjustable discharge outlets in the bottom thereof are always used for the redistribution of the cleaned ballast during the continuously progressing operation and when the amount of cleaned ballast to be discharged to the bed must be changed, the outlets must be adjusted, causing the location of the discharged cleaned ballast to be changed, too. In addition, the receptacle has a massive structure and sufficient storage capacity to store sufficient ballast for an ensuing operating stage after an interruption of the operation, powerful lifting devices being required for raising the full storage receptacle off the track when the machine is moved to another working site. The machine can be moved only very slowly along the track and this reduces the operating efficiently since track sections requiring ballast cleaning are usually spaced apart by relatively large distances. When the receptacle is lifted off the track and suspended on the frame, particularly when the machine moves from working site to working site, the frame will be subjected to an excessive load.

U.S. Pat. No. 4,108,076, dated Aug. 22, 1978, also discloses a mobile ballast cleaning machine with a receptacle mounted between two undercarriages for redistributing the cleaned ballast in the area where the ballast has been excavated.

In these conventional self-propelled ballast cleaning machines it is, therefore, often difficult to redistribute the excavated and cleaned ballast properly and evenly under the track consisting of rails fastened to ties. These difficulties are often due to the fact that the means for excavating, cleaning and redistributing the ballast are all driven at a constant, unchanging speed. If the speed of the machine advancing continuously along a track section on which its works is changed, the amounts of ballast excavated in a comparative constant time period changes accordingly. For instance, relatively large amounts of ballast are in transit on the excavating and redistributing conveyors when the forward speed of the machine is reduced and an excess amount of cleaned ballast is present, compared to the amount needed to fill the excavated bed in that period of time. To assure a constant track level after the ballast cleaning operation, the excess ballast must be moved away, for instance by suitable plow arrangements which will displace the ballast to the side-banks. On the other hand, this excess cleaned ballast will be missing later when the forward speed of the machine can be increased again due to improved local conditions. These disadvantages have been overcome by the provision of a storage of cleaned ballast which may be released for redistribution at will. This, on the other hand, has led to the difficulties discussed hereinabove in connection with conventional machines with such storage receptacles. Additionally, difficulties have been encountered when the advance of the ballast cleaning machine must be interrupted because of such track structures, for example, as bridges, track crossings and the like. In these instances, the portion of the excavating chain running transversely through the ballast bed under the track must usually be dismounted, which is quite time-consuming, and care must be taken that the excavated ballast bed between the point of excavation and the point of redistribution of cleaned ballast can be effectively filled with cleaned ballast after the excavating chain has been dismounted. Difficulties have been encountered with the conventional ballast cleaning machines when the ballast cleaning operation is continued immediately after such an interruption and the re-insertion of the excavating chain in the ballast bed to have immediately sufficient cleaned ballast available to fill the excavated track section before the newly excavated ballast is cleaned and redistributed.

These timing considerations are of particular importance when the time for the ballast cleaning operation is limited and must be completed without interfering with subsequent track surfacing work. On the other hand, it is also important, for instance when ballast cleaning machines are used in front of track renewal trains, to assure an accurately graded ballast bed on which the track ties rest so that the track replacement may proceed properly.

It is accordingly the primary object of this invention to provide a mobile ballast cleaning machine with storage capacity for cleaned ballast, wherein a sufficient supply of cleaned ballast to the redistributing system is assured under different operating conditions, resulting not only in a high efficiency of the machine during operation but also in a considerable reduction in the time required for necessary manipulations during an interruption of the ballast excavating and cleaning operation.

Such an improved ballast cleaning machine will be particularly useful in producing a suitable ballast bed before a track renewal train is moved over the track to replace old track with new track.

In a mobile ballast cleaning machine comprising a frame mounted on two undercarriages for mobility along a track in an operating direction, a rear one of the undercarriages being supported on a track section resting on cleaned ballast, a chain for excavating and conveying ballast from another track section in front of the track section resting on the cleaned ballast, the chain being mounted on the frame and having an output, a ballast screening and cleaning means arranged on the frame to receive the excavated and conveyed ballast from the output of the chain and to clean the ballast, the screening and cleaning means including means defining at least one discharge opening for the screened and cleaned ballast, and a storage receptacle arranged on the frame between the undercarriages and having a ballast input opening, the above and other objects of the invention are accomplished by positioning the ballast input opening of the storage receptacle so as to receive the cleaned ballast from the discharge opening means and having discharge means for the cleaned ballast, the storage receptacle having sufficient capacity to hold a volume of cleaned ballast corresponding to that of the excavated ballast. A rising ballast conveyor is mounted in the storage receptacle for distributing the cleaned ballast therein, and means for redistributing the cleaned ballast rearwardly of the other track section and forwardly of the rear undercarriage includes ballast conveyor means and means for regulating the flow of the cleaned ballast and for guiding the same between the discharge means of the storage receptacle and the ballast conveyor means.

Unexpectedly, a ballast cleaning machine of the above-indicated construction according to the present invention is readily and simply adaptable to various operating conditions while assuring that the excavated ballast bed section may always be filled with cleaned ballast, thus enabling other track working machines to be operated immediately after the ballast cleaning machine has passed. More particularly, since the ballast redistributing conveyor is associated with the storage space, the desired amount of cleaned ballast may always be moved to the excavated ballast bed section, thus producing the exact ballast bed depth desired for support of the track at the desired level. Since a minimum of control steps are required to obtain this result, the machine is highly efficient in redistributing the cleaned ballast.

The special storage receptacle arrangement according to this invention furthermore makes it possible to equalize irregularities with respect to changing conveyor speeds between the excavating chain and the redistributing conveyor. It also makes it possible to clean the ballast in transit even after the machine operation has been stopped for some time and then to store the cleaned ballast to be ready for redistribution. Since the ballast is stored on the frame in a track section remote from the excavated track section where the track is not supported by any underlying ballast, the unsupported track is not subjected to the load of the stored ballast, nor is this track section where ballast is excavated and then redistributed made inaccessible and obscured by the storage receptacle thus making it possible to carry on desired work at this track point.

Also, since the means for regulating and redistributing the cleaned ballast is not used for storage, these means may remain adjusted to a desired ballast bed profile while ballast is temporarily stored and no resetting of these means is required after resumption of the operation. Finally, the ballast conveyor in the storage receptacle and the resulant distribution of the cleaned ballast in the receptacle makes it possible to utilize the entire storage space so that the dimension of the receptacle may be limited without reducing the storage capacity.

The above and other objects, advantages and features of the invention will become more apparent from the following detailed description of certain now preferred embodiments thereof, taken in conjunction with the accompanying schematic drawing wherein FIG. 1 is a side elevational view showing the essential structures of a ballast cleaning machine according to the present invention, including the storage receptacle, the sub-grade and ballast bed planing means and the track lifting and lining equipment associated with the excavated track section, FIG. 2 is a like enlarged view showing the storage receptacle and the ballast conveyor associated therewith of the machine of FIG. 1, FIG. 3 is a front view of the storage receptacle and ballast conveyor of FIG. 2, and FIG. 4 is a like view of another embodiment of the storage receptacle and associated ballast conveyor.

Referring now to the drawing and first to FIGS. 1 and 2, illustrated mobile ballast cleaning machine 1 is a self-propelled machine comprising frame 3 mounted on two undercarriages 4, 5 for mobility along a track consisting of rails 6 fastened to ties 7 in an operating direction indicated by arrow 2. Rear undercarriage 5, as seen in the operating direction, is supported on track section 9 resting on cleaned ballast while front undercarriage 4 is supported on track section 8 whose ballast is to be cleaned as the machine advances thereover. Ballast is excavated at another track section 10 between the one track section 9 and track section 8 on which undercarriage 4 runs. The dirty ballast is excavated at track section 10 and, after cleaning, is redistributed there under the track so that the redistributed cleaned ballast supports the track at a desired level.

Chain 11 is mounted on frame 3 for excavating and conveying ballast from other track section 10 in front of track section 9 resting on cleaned ballast. In the illustrated machine, the ballast excavating and conveying chain is of conventional design and is comprised of an endless chain having a triangular conveyor path, a transverse portion of the chain in the conveying path serving to excavate the ballast from other track section 10, for which purpose this transverse chain portion is guided in the ballast bed under the track, all in an entirely conventional manner. As is well known, trough-shaped guide elements are provided for the endless excavating and conveying chain, which is a link chain equipped with conveying shovels and excavating fingers digging into the ballast. The obliquely positioned endless ballast excavating and conveying chain rises from its transverse chain portion to an output in the range of which a drive motor is arranged for driving the chain in its conveying path. Similarly conventional ballast screening and cleaning means 12 is arranged on frame 3 to receive the excavated and conveyed ballast from the output of chain 11 and to clean this ballast.

Ballast screening and cleaning means 12 illustrated by way of example is similar to the one disclosed and claimed in our copending application Ser. No. 961,566 filed Nov. 17, 1978. It comprises a screen arrangement with several superposed screens of different mesh sizes and equipped with a vibratory drive for vibrating the screens. The rubble passing through the bottom of the screen arrangement is carried away by endless conveyor band arrangement 14 designed to deposit this waste on the side-banks next to the track or on freight cars coupled to the machine. An end wall of housing 13 holding the screens defines discharge openings 15 associated with each screen for the screened and cleaned ballast.

In accordance with this invention, cleaned ballast storage arrangement 17 comprises storage receptacle 23 arranged on frame 3 between undercarriages 4 and 5. The receptacle has a ballast input opening 24 positioned to receive the cleaned ballast from discharge openings 15 and, in turn, has discharge means 38 for the cleaned ballast. The storage receptacle has storage space 21 of sufficient capacity to hold a volume of cleaned ballast corresponding to that of the excavated ballast, preferably at least five to six cubic meters of cleaned ballast. Receptacle 23 has an edge defining the input opening facing ballast screening and cleaning means 12 so as to catch the cleaned ballast falling out of discharge openings 15 and rising rearwardly, the walls of the receptacle defining storage space 21. This configuration of the storage receptacle makes it possible to receive in its storage space all the excavated and cleaned ballast in transit at the time the operation is stopped and to supply sufficient cleaned ballast for filling the excavated track section when operation is resumed.

Rising ballast conveyor 30 is mounted in the storage receptacle within the range of the input opening and partially within storage space 21 for distributing the cleaned ballast therein. The ballast conveyor is comprised of endless conveyor chain 31, chain drive 32 being arranged at the top discharge point of the chain drive. A discharge port adjustable by movable gate 34 is defined in the rear wall of storage receptacle 23 in the range of the discharge point of conveyor chain 31 and endless ballast conveyor 33 is associated with the discharge port to receive cleaned ballast therefrom when gate 34 is open and sufficient ballast is stored in receptacle 23 to reach the discharge port. The endless ballast conveyor is supported on machine frame 3 for pivoting transversely to the track direction and extends in a longitudinal direction for conveying unwanted cleaned ballast rearwardly beyond rear undercarriage 5 for suitable storage or disposal.

Means for redistributing the cleaned ballast is arranged rearwardly of excavated track section 10 and forwardly of rear undercarriage 5 so as to receive cleaned ballast either directly from discharge openings 15 or discharge means 38. This ballast redistributing means includes ballast conveyor means comprising endless conveyor band 16 and means 36, 37 for regulating the flow of the cleaned ballast and for guiding the same between discharge means 38 of the storage receptacle and endless conveyor band 16.

Bottom 27 of storage receptacle 23 has, as shown in FIG. 3, a series of adjustable outlets 28 extending over the width of the track and associated with a system 25 of ballast distributing chutes 29. Chute system 25 is vertically adjustably mounted on machine frame 3 by hydraulic motors 26 for suitable positioning in relation to the track.

The ballast flow regulating means includes pivotal gate 36 adjustable into selected pivotal positions by hydraulic motor 35. The gate is pivoted to the lower edge defining input opening 24 of receptacle 23 and, as shown in full and broken lines in FIG. 2, may be adjusted to regulate not only the flow of cleaned ballast from discharge openings 15 into the storage receptacle but also towards conveyor 16. The ballast flow is regulated further by pivotal distributing baffle 37 mounted at the inlet end of conveyor 16 for directing the flow of cleaned ballast either to the conveyor for redistribution at the excavated track section or, in the position indicated in broken lines, directly to the track section below the discharge openings of screening and cleaning means 12.

The arrangement of the adjustable ballast distributing chutes across the width of the track increases the adaptability of the machine since it makes it possible to redistribute cleaned ballast not only by conveyor 16 but, if this turns out to be insufficient, also directly from the storage receptacle.

Discharge means 38 is a port arranged in a lower portion of storage receptacle 23 facing ballast screening and cleaning means 12 and pivotal gate 39 cooperates with the discharge port for adjusting its opening. The conveyor path of the excavated ballast thus comprises excavating chain 11, ballast screening and cleaning means 12, storage arrangement 17 and conveyor 16 leading back to the excavated track section. Further ballast conveyor 14, which may be a screw conveyor 40, is arranged in the lower portion of the storage receptacle and is arranged to convey the cleaned ballast stored there to discharge port 38. Screw conveyor 40 may be driven by any suitable drive, for example hydraulic motor 42.

This highly adjustable system for redistributing and regulating the flow of the cleaned ballast in a closed conveyor path makes it possible rapidly and simply to adjust the ballast flow in any desired manner, for instance by directing the cleaned ballast directly from the cleaning screen arrangement to the redistributing conveyor and without intervening storage, for instance when no further ballast is excavated and it is desired only to fill the excavated track section. Placing the screw conveyor in the bottom of the storage receptacle additionally regulates the ballast flow and moves cleaned ballast from the bottom of the receptacle to the discharge port for delivery to the redistributing conveyor 16.

FIG. 3 illustrates one preferred embodiment of rising ballast conveyor 30. As shown, this conveyor comprises endless link chain 31 for receiving and conveying the cleaned ballast, the chain being partially immersed in storage space 21 of receptacle 23 and extending to an upper ballast discharge portion. Drive 32 for the endless link chain is arranged in the upper ballast discharge portion. The chain consists of links equipped with ballast conveying shovels 44 and is mounted in polygonal guide 45 including section 43 wherein the link chain is positioned in a direction transverse to the track and below discharge opening means 15 of ballast screening and cleaning means 12. As indicated by a double-headed arrow, drive 32 is arranged for selectively moving endless link chain 31 in opposite directions for discharging ballast at the top to the right or to the left. As shown, guide section 43 is positioned in a bottom ballast receiving portion of the storage receptacle above bottom 27 of the receptacle. In this way, the bottom ballast receiving portion can hold some cleaned ballast and rising ballast conveyor 30 need by operated only after this bottom receptacle portion has been filled.

This conveyor arrangement assures a suitable distribution of the cleaned ballast in the entire storage space and this rapid distribution of the ballast in the receptacle assures the proper storage of even large amounts of cleaned ballast resulting from a high operating speeds and correspondingly large amounts of excavated ballast without unduly large dimensioning of the storage capacity. This advantage is increased by the fact that the ballast is received and conveyed by the chain itself and, compared to conveyor band arrangements, requires no further equipment for delivering the ballast.

The manifold possibilities for redistributing the cleaned ballast to various selected track sections and areas is further increased by the provision of discharge ports 46 and 47 in the side walls of receptacle 23, which may be closed entirely or may be adjustably opened by suitable pivotal gates driven by hydraulic motors, for example (not shown), similarly to gates 34 and 36. In this manner, cleaned ballast may be redistributed in the side-banks laterally of the track or, if too much ballast is stored in the receptacle, excess ballast may be discharged through these ports for storage along the side-banks, as well as being moved away by conveyor 33.

Another preferred embodiment of the rising ballast conveyor 30 in storage receptacle 54 is shown in FIG. 4. This conveyor comprises a pair of like endless link chains 49, 50 for receiving and conveying the cleaned ballast, the link chains being partially immersed in storage space 48 of the receptacle and each link chain being arranged in a half of the storage space symmetrically with respect to a center region of the storage space. Each link of the chains carries a ballast conveying shovel 51 and the two facing chain portions in the center region run in common guide 52 divided by center web 53. A drive 55 is associated with each conveyor chain at the top for driving the chains. The provision of two separate and separately driven conveyor chains makes it possible to transfer selected amounts of cleaned ballast from one half of the storage space to the other half and to distribute the stored ballast over the entire storage space in any desired manner. As in the embodiment of FIG. 3, receptacle bottom 56 has outlet ports which are adjustable by pivotal chutes 57 and 58 to enable the ballast from the receptacle to be redistributed selectively over the entire width of the track.

As shown, this embodiment further comprises conveyor band means associated with the storage receptacle for conveying the cleaned ballast laterally and rearwardly, the illustrated conveyor band means including a respective conveyor band 59 associated with each pivotal chute 57 for laterally conveying cleaned ballast to the side-banks and conveyor band 60 associated with pivotal chutes 58 for selectively conveying cleaned ballast forwardly to conveyor 16 or rearwardly beyond rear undercarriage 5 for intermediate storage on freight cars coupled to the machine or on the side-banks of the track. As schematically illustrated by circling arrows, conveyor bands 59 are mounted for pivoting about a vertical axis in a horizontal plane to increase the distribution range of the conveyor bands.

The independent, selective delivery of cleaned ballast to selected halves of the storage receptacle generally improves the distribution of the ballast in the storage space and is of particular advantage in superelevated track curves where gravity will cause uneven ballast distribution in one half of the receptacle, which can be equalized by operation of one of the conveyor chains. The provision of the additional redistributing conveyors 59 and 60 enables cleaned ballast to be stored on the side-banks along the entire track so that, for example, after a subsequent track renewal operation including the laying of new ties, sufficient cleaned ballast is stored to fill the cribs between the new ties.

As has been shown in FIG. 1, a conventional track lifting and, if desired, lining means 20 is mounted on machine frame 3 adjacent the transverse chain portion of excavating chain 11 to enable the track to be lifted at the point of ballast excavation. Ballast planing and compacting means 18 is arranged rearwardly of track lifting means 20 and means 19 for compacting the sub-grade at track section 10 from which the ballast has been excavated is positioned between the transverse chain portion which excavates the ballast and ballast planing and compacting means 18. The ballast planing and compacting means and the sub-grade compacting means are mounted on the guide for excavating chain 11 by means of hydraulic motors which enable these means to be vertically adjusted to desired levels for the ballast bed and the sub-grade, respectively. A conventional reference system (not shown for reasons of clarity) for measuring and monitoring the position of the track section resting on the cleaned ballast may be associated with machine 1 to measure and monitor such parameters, for example, as the excavating depth, the height of the ballast bed and the depth of the sub-grade, all in a manner well known per se. The monitoring and indicating devices of the reference system are preferably remote-controlled, and a machine equipped in this manner will be able to produce a very accurately determined ballast bed position at a desired grade ready to receive a new track in an ensuing track renewal operation.

Machine 1 with the described and illustrated type of cleaned ballast storage and redistribution may be operated in the following manner exemplifying the wide adaptability of the machine to various operating conditions:

As the machine is propelled in operating direction 2 by a drive associated in a schematically illustrated manner with rear undercarriage 5, chain 11 will continuously excavate ballast from track section 10 under rails 6 and ties 7 of the track, and will convey the excavated ballast to screening and cleaning means 12. Rubble or waste is separated from useful ballast on the vibrating screens of means 12 and the rubble is removed by conveyor 14 to be loaded on freight cars following machine 1 or to be deposited along the embankment. The cleaned ballast drops through discharge openings 15 and is received, depending on the position of pivotal baffle 36, more or less or exclusively by input opening 24 in the bottom receiving portion of the storage receptacle and/or in the range of distributing baffle 37 which selectively directs the cleaned ballast to redistributing conveyor 16 or to the track section underneath discharge openings 15.

As will be clear from the above-described structure of the ballast flow regulating means illustrated in the drawing, cleaned ballast may be redistributed entirely by longitudinal conveyor 16 whose output end is arranged to throw the ballast conveyed thereby into the excavated track section under the track, as shown in FIG. 1, while the storage receptacle remains closed and no ballast stored therein is redistributed. After excavation and before the cleaned ballast is redistributed, the sub-grade in track section 10 is planed and compacted by surface compactor means 19 and the redistributed cleaned ballast is then planed and compacted by surface compactor 18 to provide a leveled supported bed on which track ties 7 rest.

Suitable positioning of pivotal guide baffle 37 at the input end of conveyor 16 will enable a selected amount of cleaned ballast to be conveyed forwardly to track section 10 and to be deposited in the cribs under the baffle.

If local conditions require the continuous advance of machine 1 to be slowed or entirely interrupted, regulating baffle 36 is pivoted to the right, as seen in FIG. 2, so that a part or all of the ballast still in the conveying path of chain 11 and cleaning screen arrangement 12 is directed into input opening 24 of the storage receptacle. When the machine is halted, all of the cleaned ballast still in transit at that time will be directed from the screen arrangement into the storage receptacle.

If the volume of cleaned ballast exceeds the capacity of the bottom receiving portion of the storage receptacle, drive 32 or 55 is operated to drive rising ballast conveyor 30 so as to distribute the stored ballast over the entire storage space.

When the machine advance is resumed or its speed increased again, the cleaned ballast stored during the interim period can be used for redistribution by opening pivotal gate 39, the cleaned ballast being moved to discharge means 38 by conveyor screw 40 and being directed from the open discharge to conveyor 16 for redistribution at excavated track section 10. This stored ballast will thus compensate immediately for the lack of ballast coming from excavating chain 11 at the beginning of the resumption or speed-up of the advance of machine 1. As the machine advances at increasing speed, additional cleaned ballast will come from screening and cleaning means 12 for redistribution to selected areas of the track. Sufficient cleaned ballast is always stored to permit track section 10 excavated when the machine has been temporarily halted to be filled when cleaned ballast from the storage receptacle as the machine is set in motion again, as well as for filling the cribs by operating the pivotal chutes at the bottom of the storage receptacle.

If the ballast cleaning operation produces more ballast than is needed to fill the excavated track section 10 as well as the cribs between this track section and the storage receptacle, which is the case when the track level is lowered, for instance in electrified tracks for obtaining a maximal verical distance between the running face of the rails and the lower edge of the third rail, excess cleaned ballast may be carried away by endless conveyor 33 or 60 to freight cars coupled to machine 1 or to be deposited on the side-banks next to the track for possible later use after a subsequent track renewal operation.

As is obvious from the above description of the structure and function of the storage receptacle of the present invention, it may be used not only for storing cleaned ballast but its bottom is so constructed that is may also serve for redistributing such ballast.

Mounting the ballast storage receptacle in the conveying path of the ballast between screening and cleaning means 12 and ballast redistributing conveyor 16 has the advantage that excavated track section 10 may always filled up to the underside of ties 7, where the ballast is planed and compacted by surface comparator 18, immediately on resumption of operations after a ballasting operation has had to be halted and the excavating chain withdrawn from the ballast bed. Rising ballast conveyor 30 in the storage receptacle enables the storage space capacity to be used fully since it distributes the cleaned ballast over all parts of the receptacle so that relatively large amounts of cleaned ballast accumulating, for example, when the advance of machine 1 is suddenly halted or considerably slowed down may be stored in the receptacle. Using chains with shovels digging into the ballast for conveying the ballast from the bottom part of the receptacle has the advantage that conveyor 30 will distribute the ballast over the entire storage space without the need for additional means for delivering the ballast to the conveyor, which is required is case of conveyor bands and causes delays.

While power drives have been shown only in connection with some of the adjustable gates and chutes for regulating and directing the flow of the cleaned ballast, it will be understood that such drives are provided for all of these adjustable gates and chutes, and while they have been shown as pivotal members, they may also be mounted for reciprocation or in any other suitable manner permitting their adjustment. These drives may be operated independently or at least some of them may be operated in a group from central operator's cab 61 mounted on machine frame 3 above front undercarriage 4. The drive for advancing machine 1 along the track may also be controlled from cab 61, particularly during the ballasting operation.

Furthermore, it should be noted that chain drives 32 and 55 for the rising ballast conveyor in the storage receptacle may be operated for driving the conveyor chains in either direction to vary the range in which the conveyor discharges the conveyed ballast in the storage space. Furthermore, guides 45 and 52 for these conveyor chains may, if desired, have adjustable outlets for discharging selected amounts of conveyed ballast along the conveying path in desired areas of the storage space along these guides.

Finally, the machine of the present invention is not limited to a single ballast redistributing conveyor 16. For example, the storage receptacle may have an adjustable chute 39 associated with each rail 6 and a separate conveyor 16 may be associated with each chute and extend substantially above the associated rail so that the cleaned ballast may be redistributed essentially in the areas of the rails. Also, as is known in ballast cleaning machines of this general type, the ballast redistributing conveyor or conveyors may be pivotal in a substantially horizontal plane transversely to the track for relocating their discharge ends.

What is claimed is:

1. A mobile ballast cleaning machine comprising (a) a frame mounted on two undercarriages for mobility along a track in an operating direction, (b) a chain for excavating and conveying ballast mounted on the frame and having an output, (c) a ballast screening and cleaning means arranged on the frame to receive the excavated and conveyed ballast from the output of the chain and to clean said ballast, the screening and cleaning means including (1) means defining at least one discharge opening for the screened and cleaned ballast, (d) a storage receptacle arranged on the frame between the undercarriages and having a ballast input opening positioned to receive the cleaned ballast from the discharge opening means and having discharge means for the cleaned ballast, (e) a rising ballast conveyor mounted in the storage receptacle for distributing the cleaned ballast therein, and (f) means for redistributing the cleaned ballast, the redistributing means including (1) ballast conveyor means and (2) means for regulating the flow of the cleaned ballast and for selectively guiding the same between the input opening of the storage receptacle and the ballast conveyor means.

2. The mobile ballast cleaning machine of claim 1, wherein a rear one of the undercarriages is supported on a track section resting on cleaned ballast, the chain is arranged for excavating and conveying ballast from another track section in front of the track section resting on cleaned ballast, the cleaned ballast redistributing means is arranged rearwardly of the other track section and forwardly of the rear undercarriage, and the storage receptacle has sufficient capacity to hold a volume of cleaned ballast corresponding to that of the excavated ballast.

3. The mobile ballast cleaning machine of claim 2, wherein the storage receptacle is arranged between the discharge opening means of the ballast screening and cleaning means and the rear undercarriage.

4. The mobile ballast cleaning machine of claim 1 or 3, wherein the rising ballast conveyor comprises an endless link chain for receiving and conveying the cleaned ballast, a polygonal guide for the link chain, the guide including a section wherein the link chain is positioned in a direction transverse to the track and below the discharge opening means of the ballast screening and cleaning means, and the endless link chain being partially immersed in the storage space of the receptacle and extending to an upper ballast discharge portion, and a drive for the endless link chain in the range of the upper ballast discharge portion.

5. The mobile ballast cleaning machine of claim 4, wherein the drive is arranged for selectively moving the endless link chain in opposite directions.

6. The mobile ballast cleaning machine of claim 4, wherein the storage receptacle has a ballast receiving portion open towards the discharge opening means of the ballast screening and cleaning means, the ballast receiving portion being arranged below the discharge opening means and having a bottom, the guide section wherein the link chain is transverse to the track being positioned in the ballast receiving portion above the bottom thereof.

7. The mobile ballast cleaning machine of claim 1 or 3, wherein the rising ballast conveyor comprises a pair of endless link chains for receiving and conveying the cleaned ballast, the endless link chains being partially immersed in the storage space of the receptacle and each one of the endless links chains being arranged in a half of the storage space, and a drive for each one of the endless link chains, the drives being arranged to move the endless link chains in directions leading to a center region of the storage space.

8. The mobile ballast cleaning machine of claim 1 or 3, further comprising conveyor band means associated with the storage receptacle for conveying the cleaned ballast laterally and rearwardly.

9. The mobile ballast cleaning machine of claim 8, wherein the conveyor band means comprises a pivotal ballast conveyor.

10. The mobile ballast cleaning machine of claim 9, wherein the pivotal conveyor is arranged to convey the cleaned ballast rearwardly beyond the rear undercarriage.

11. The mobile ballast cleaning machine of claim 1 or 3, wherein the means for regulating the flow of the cleaned ballast and for guiding the same comprises a pivotal chute mounted between the discharge means of the storage receptacle and the ballast conveyor means, the ballast conveyor means extending to the other track section for distributing the cleaned ballast where the chain excavated it, and the input opening being arranged in a lower portion of the storage receptacle facing the ballast screening and cleaning means.

12. The mobile ballast cleaning machine of claim 1 or 3, further comprising a further ballast conveyor arranged in a lower portion of the storage receptacle and arranged to convey stored cleaned ballast to the discharge means.

13. The mobile ballast cleaning machine of claim 1 or 3, wherein the storage receptacle has a bottom facing the track and a system of ballast distributing chutes is associated with the receptacle bottom, the chutes extending over the width of the track and each chute being associated with an adjustable ballast outlet in the bottom of the receptacle.

14. The mobile ballast cleaning machine of claim 1 or 2, wherein the storage receptacle has a storage space of a capacity of at least five to six cubic meters of cleaned ballast, the receptacle having an edge defining the input opening facing the ballast screening and cleaning means and rising rearwardly.

15. The mobile ballast cleaning machine of claim 1 or 3, wherein the ballast excavating and conveying chain is an endless chain having a triangular conveying path, a transverse portion of the chain in the conveying path serving to excavate the ballast from the other track section, and further comprising track lifting means adjacent the transverse chain portion, a ballast planing and compacting means rearwardly of the lifting means, and a means for compacting the sub-grade at the other track section from which the ballast has been excavated, the sub-grade compacting means being positioned between the transverse chain portion and ballast planing and compacting means.

* * * * *